US008040035B2

(12) United States Patent
Lemaitre

(10) Patent No.: US 8,040,035 B2
(45) Date of Patent: Oct. 18, 2011

(54) METHOD OF PRODUCING A HIGH VOLTAGE STABLE CATHODE FOR AN X-RAY TUBE

(75) Inventor: Sergio Lemaitre, Whitefish Bay, WI (US)

(73) Assignee: General Electric Company, Schenectady, NY (US)

( * ) Notice: Subject to any disclaimer, the term of this patent is extended or adjusted under 35 U.S.C. 154(b) by 70 days.

(21) Appl. No.: 12/495,886

(22) Filed: Jul. 1, 2009

(65) Prior Publication Data

US 2009/0260233 A1 Oct. 22, 2009

Related U.S. Application Data

(62) Division of application No. 11/160,623, filed on Jun. 30, 2005, now Pat. No. 7,576,481.

(51) Int. Cl.
*H01J 61/10* (2006.01)

(52) U.S. Cl. ..... 313/356; 313/38; 313/238

(58) Field of Classification Search ..... 445/34; 313/334, 37, 346, 356, 346 R, 331, 364–477 HC, 313/292, 352, 38, 270, 238; 378/121, 125, 378/130, 178, 122, 142, 141, 114, 145, 113, 119, 134, 135, 140, 136–138; 220/2.1 A, 2.2, 2.1 R, 2.3 A, 2.3 R
See application file for complete search history.

(56) References Cited

U.S. PATENT DOCUMENTS

2002/0187711 A1* 12/2002 Kautz et al. ..... 445/28
* cited by examiner

*Primary Examiner* — Toan Ton
*Assistant Examiner* — Fatima Farokhrooz
(74) *Attorney, Agent, or Firm* — Fletcher Yoder

(57) ABSTRACT

A method of producing a cathode for use in an x-ray tube assembly is provided including machining an emission aperture into a cup emission surface portion of a cup structure. The cup structure is comprised of a cup base portion opposite the cup emissions surface portion. Electro-discharge machining is used to form an electro-discharge machining slot into the cup structure to provide access to the interior of the cup structure. Electro-discharge machining is used to form a transverse coil chamber within the interior by way of the electro-discharge machining slot such that the transverse coil chamber is formed between the cup base portion and the cup emissions surface portion while retaining an essentially contiguous emissions surface perimeter surrounding the emission aperture.

12 Claims, 2 Drawing Sheets

METHOD OF PRODUCING A HIGH VOLTAGE STABLE CATHODE FOR AN X-RAY TUBE

CROSS-REFERENCE TO RELATED APPLICATIONS

This application is a divisional of and claims priority to U.S. patent application Ser. No. 11/160,623, filed on Jun. 30, 2005, the disclosure of which is incorporated herein by reference.

BACKGROUND OF THE INVENTION

This disclosure relates generally to a cathode for use in an x-ray tube assembly and more particularly to a method for electro-discharge machining a cathode for use in an x-ray tube assembly.

Existing medical x-ray tube assemblies include a cathode assembly having an emitter and a cup. The cathode assembly is orientated to face an x-ray tube anode, or target, which is typically a planar metal or composite structure. The space between the cathode and the anode is evacuated.

A concern with existing cathode designs is that the emitter, often a helically coiled tungsten wire filament, tends to be large and electrons are emitted radially outward from all side surfaces of the filament surface. The filaments are therefore positioned within a cup that is designed to produce a tailored electric potential distribution in the vacuum such that all electron trajectories are redirected from the initial divergent motion toward a focal spot on the anode surface. This is accomplished by way of carefully machining the cathode cup to passively shape the electric field leading to the focal spot. This often takes the form of multiple transverse slots formed in the center of the cathode cup.

The use of common machining techniques, however, tends to result in a large transverse section removed from the cup. This leaves sections of the cup with sharp features at the edges of the cup referred to as ears. These sharp features lead to high electric field stress and undesirable consequences of high voltage stability issues. In order to compensate for such sharp-eared features, one approach has been to install a ring shield around the perimeter of the cup. This approach, however, introduces an increase in cost due to additional part manufacturing and an increase in complexity of the cathode assembly. A cathode cup assembly with improved design and manufacturing that eliminated the need for a separate ring shield while providing improved high voltage stability would provide for improved tailored performance of the x-ray assembly and may be used to reduce manufacturing and assembly costs.

Therefore, it would be desirable to provide a method for manufacturing a cathode assembly that has smooth cathode cup surfaces suitable for high voltage stability. Additionally, it would be highly desirable to provide a method for producing a cathode assembly that has adequate shielding without requiring additional part manufacturing and assembly.

BRIEF DESCRIPTION OF THE INVENTION

A method of producing a cathode for use in an x-ray tube assembly is provided including machining an emission aperture into a cup emission surface portion of a cup structure. The cup structure is comprised of a cup base portion opposite the cup emissions surface portion. Electro-discharge machining is used to form an electro-discharge machining slot into the cup structure to provide access to the interior of the cup structure. Electro-discharge machining is used to form a transverse coil chamber within the interior by way of the electro-discharge machining slot such that the transverse coil chamber is formed between the cup base portion and the cup emissions surface portion while retaining an essentially contiguous emissions surface perimeter surrounding the emission aperture.

Other features of the disclosure will become apparent when viewed in light of the detailed description of the preferred embodiment when taken in conjunction with the attached drawings and appended claims.

DETAILED DESCRIPTION OF THE INVENTION

Figure 1:
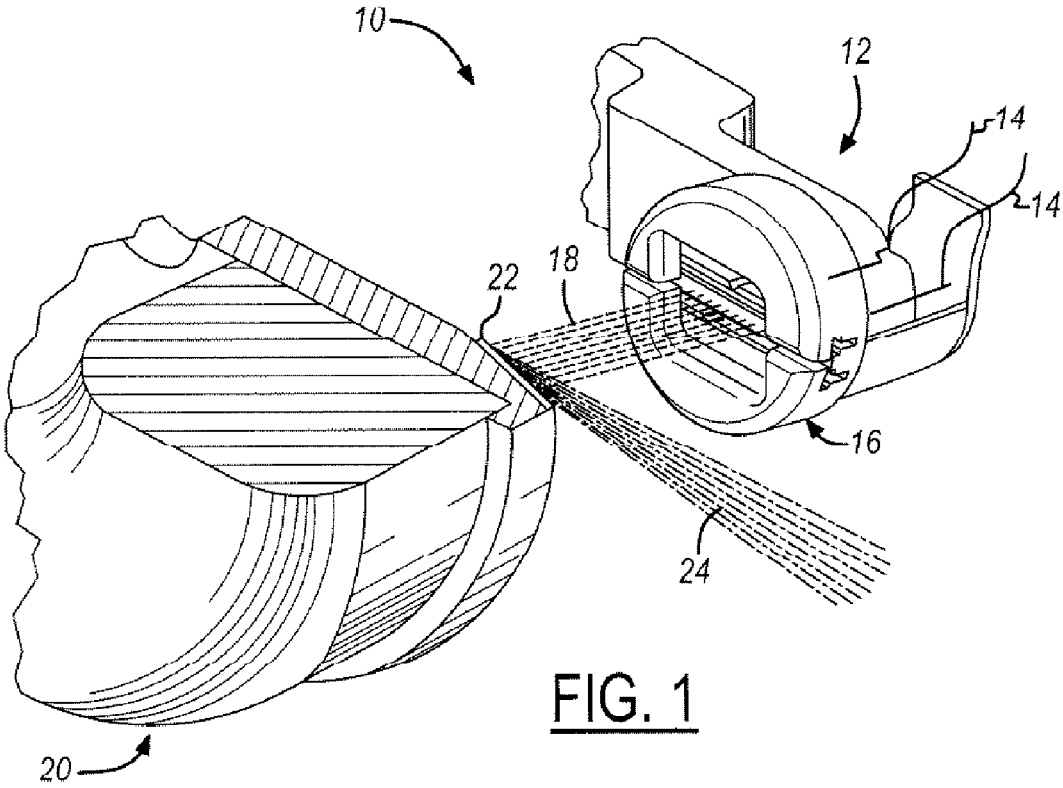
FIG. 1 is an illustration of an x-ray tube assembly including a cathode assembly produced by electro-discharge machining.

Referring now to the drawings, FIG. 1 is an illustration of an x-ray tube assembly 10. The x-ray tube assembly 10 is preferably for medical imaging applications although a variety of applications may be adapted in light of this disclosure. The x-ray tube assembly 10 includes a cathode assembly 12 having a plurality of wire filaments 14 positioned within a cup structure 16 for the generation of an electron beam 18. The beam 18 is directed towards an anode assembly 20 wherein the beam 18 impacts a target assembly 22 for the generation of x-rays 24 as is known in the art. The target assembly 24 is preferably rotated to prevent excess heat generation.

Figure 2:
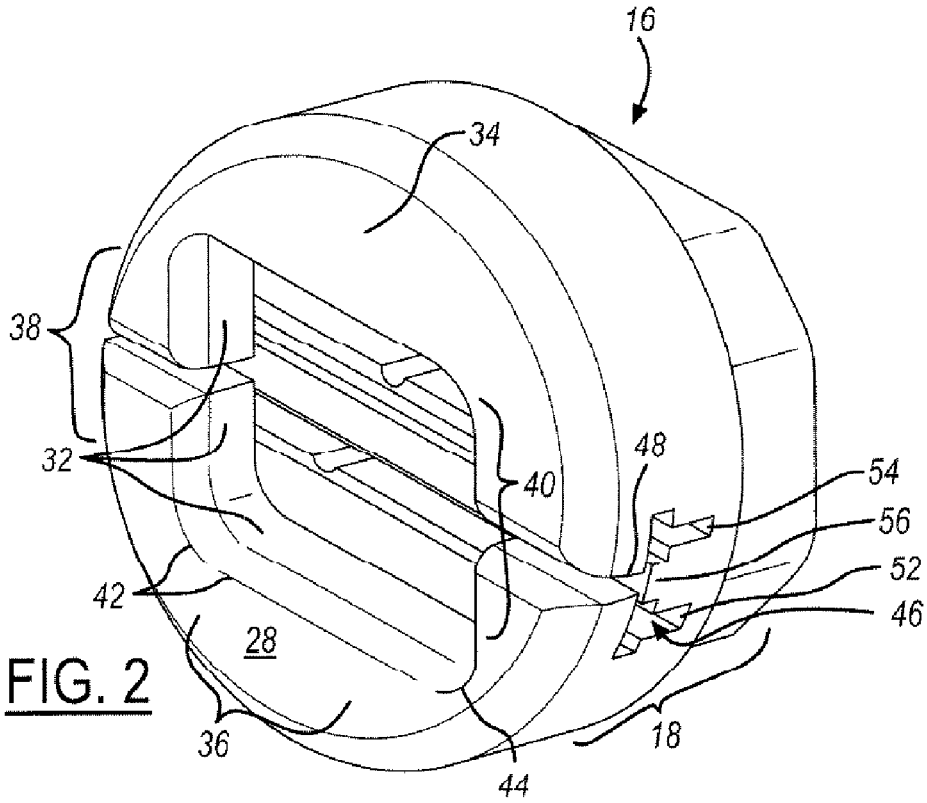
FIG. 2 is a detailed illustration of the cathode assembly illustrated in FIG. 1.

A unique method of producing and resultant cup structure 16 for use in the x-ray tube assembly 10 described. The cup structure 16 is comprised of a single piece cup structure 16 having a cup base portion 26 positioned below a cup emission surface portion 28 (see FIG. 2). An emission aperture 30 is machined into the cup emission surface portion 28 to form an essentially contiguous emission surface perimeter 32. The term essentially contiguous is intended to encompass the capacity to have minimal gaps in the perimeter 32 while continuing to function as a contiguous perimeter shield. The perimeter 32 is comprised of a first ear portion 34, a second ear portion 36, a first side bride 38 and a second side bride 40. The side bridge 38, 40 span between the ear portions 34,36 to form the essentially contiguous surface perimeter 32. It is contemplated the emission aperture 30 may be formed in the cup emission surface portion 28 using a variety of machining techniques. The plurality of upper aperture edges 42 are preferably machined into radiused edges to form a radiused perimeter 44.

Figure 3A:
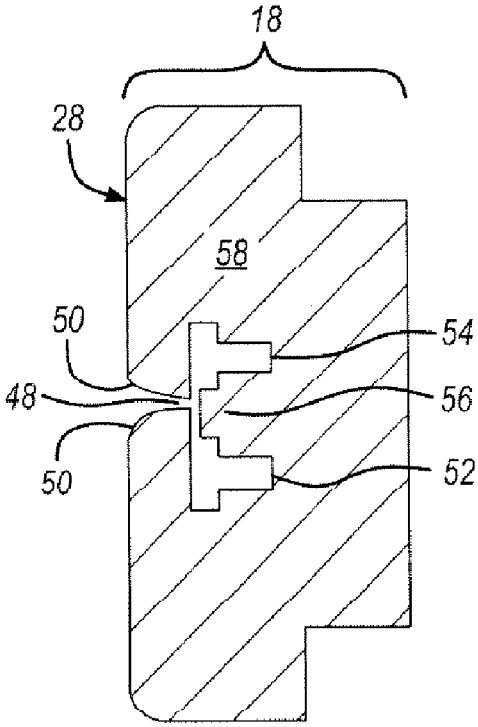
FIG. 3A is a cross-sectional illustration of the cathode assembly illustrated in FIG. 2.

A transverse coil chamber 46 is formed within the cup base portion 26 below the cup emission surface portion 28 through the use of electro-discharge machining. The cup structure 16 is produced using wire electro-discharge machining. Wire electro-discharge machining is an electro thermal production process in which a wire cuts through metal by the use of heat from electrical sparks. The spark is generated between the wire electrode and the metal when both are submerged in deionized water. The use of this technique is significant as it allows the machining to pass through a variety of locations in the cup structure 16 while only forming a narrow electro-discharge machining slot 48. Thus it can be passed through to form a complex and precise transverse coil chamber 46 without disrupting the essentially contiguous surface perimeter 32. In fact, in the embodiment illustrated in FIGS. 2 and 3A, the electro-discharge machining slot 48 can be passed directly through cup emission surface portion 28 without interfering with the essentially contiguous surface perimeter 32. In such an embodiment, it is contemplated that the entrance edges 50 be further machined into radiused edges to maintain high voltage stability.

Figure 3B:
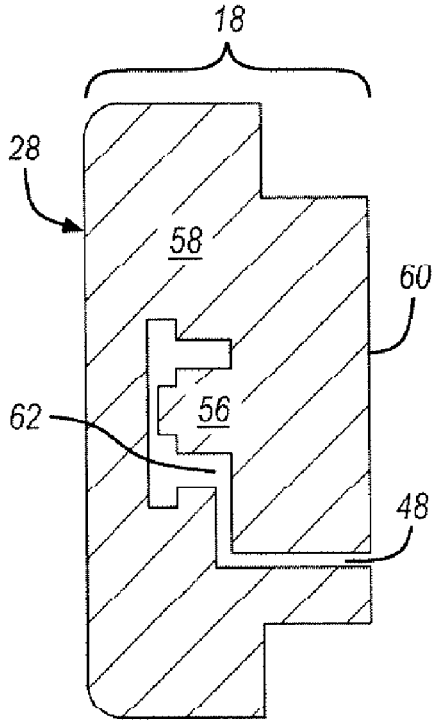
FIG. 3B is an alternate embodiment of the cathode assembly illustrated in FIG. 3A.
Figure 3C:
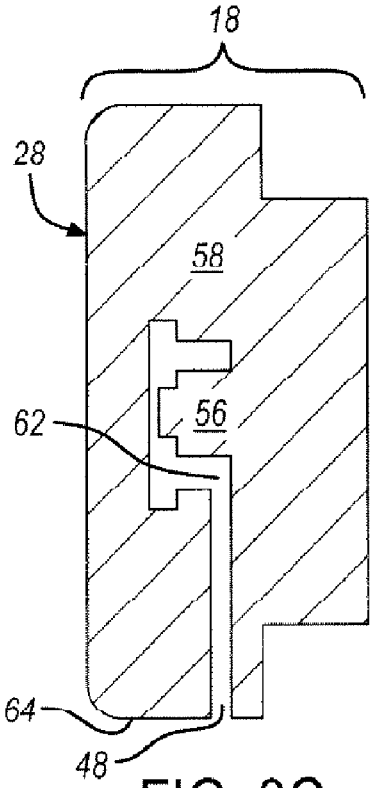
FIG. 3C is an alternate embodiment of the cathode assembly illustrated in FIG. 3A.
Figure 3D:
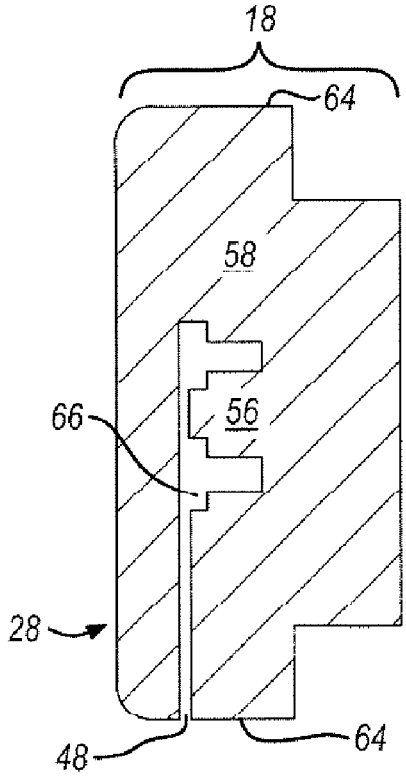
FIG. 3D is an alternate embodiment of the cathode assembly illustrated in FIG. 3A.

The transverse coil chamber 46 may be formed in a variety of fashions but is contemplated to include a large transverse coil slot 52 and a small transverse coil slot 54 formed with a separation pillar 56 positioned there between. These are formed for mounting the wire filaments 14 therein during final assembly. By routing the electro-discharge machining slot 48 through various portions of the cup structure 16 and into the interior 58 prior to formation of the transverse coil chamber 46, the cup emission surface 28 may be maintained as either completely contiguous around the perimeter 32 or essentially as previously described. The embodiments contemplated wherein that maintain complete contiguous characteristics include, but are not limited to, FIGS. 3B-3D. These include having the electro-discharge machining slot 48 enter through a rear surface 60 of the cup structure 16 and be directed towards a rearward region 62 of the transverse coil chamber 46 prior to formation (FIG. 3B). In other embodiments, the slot 48 may enter through a side surface 64 and enter either the rearward region 62 (FIG. 3C) or a forward region 66 (FIG. 3C) of the transverse coil chamber 46. Each of these embodiments integrates unique features to the resultant cup structure 16 making them tailorable to specific mounting or performance applications.

The disclosed method allows the bridge portions 38, 40 to be machined to arbitrary dimensions as is desired for individual designs. The machined bridge portions 38, 40 eliminate the need for separate tab elements utilized in prior art cups. Prior art designs required attachment of such tabs using manual processes. This method eliminates the associated complexity, cost and opportunity of failure by replacing the manual tab assembly process with a numerically controlled milling operation of the bridge portions 38, 40 of the aperture 30.

While the disclosure has been described with reference to various embodiments, those skilled in the art will appreciate that certain substitutions, alterations and omissions may be made to the embodiments without departing from the spirit of the disclosure. Accordingly, the foregoing description is meant to be exemplary only, and should not limit the scope of the disclosure as set forth in the following claims.

What is claimed is:

1. A method of producing a cathode for use in an x-ray tube assembly comprising:

machining an emission aperture into a cup emission surface portion of a cup structure, said cup structure comprising a cup base portion opposite said cup emissions surface portion, said emission aperture being surrounded by an essentially continuous emissions surface perimeter having ear portions and side bridges extending between the ear portions at the level of the cup emission surface portion;

electro-discharge machining an electro-discharge machining slot into said cup structure to provide electro-discharge machining access to the interior of said cup structure;

electro-discharge machining a transverse coil chamber into said interior through said electro-discharge machining slot such that said transverse coil chamber is formed between said cup base portion and said cup emissions surface portion, and at least partially covered by said cup emissions surface portion.

2. The method of producing a cathode for use in an x-ray tube assembly as described in claim 1, wherein said electro-discharge machining comprises wire electro-discharge machining.

3. The method of producing a cathode for use in an x-ray tube assembly as described in claim 1 further comprising machining a plurality of upper aperture edges surrounding said emissions aperture to generate a radiused perimeter.

4. The method of producing a cathode for use in an x-ray tube assembly as described in claim 1, further comprising electro-discharge machining said transverse coil chamber to generate a large transverse coil slot; a small transverse coil slot; and a separation pillar positioned between said large transverse coil slot and said small transverse coil slot.

5. The method of producing a cathode for use in an x-ray tube assembly as described in claim 1, wherein said electro-discharge machining slot enters said cup structure through a rear surface of said cup base portion.

6. The method of producing a cathode for use in an x-ray tube assembly as described in claim 1, wherein said electro-discharge machining slot enters said cup structure through a side surface of said cup base portion.

7. The method of producing a cathode for use in an x-ray tube assembly as described in claim 4, further comprising electro-discharge machining said electro-discharge machining slot into said cup emission surface portion such that said electro-discharge machining slot is aligned over said separation pillar.

8. The method of producing a cathode for use in an x-ray tube assembly as described in claim 7, further comprising machining a plurality of radiused entrance edges onto said electro-discharge machining slot where said electro-discharge machining slot intersects said cup emission surface portion.

9. The method of producing a cathode for use in an x-ray tube assembly as described in claim 6, wherein said electro-discharge machining slot enters said transverse coil chamber at a rearward region.

10. The method of producing a cathode for use in an x-ray tube assembly as described in claim 6, wherein said electro-discharge machining slot enters said transverse coil chamber at a forward region.

11. A method of producing a cathode for use in an x-ray tube assembly comprising:

machining an emission aperture into a cup emission surface portion of a single piece cup structure, said cup structure comprising a cup base portion opposite said cup emissions surface portion, said emission aperture being surrounded by an essentially continuous emissions surface perimeter having ear portions and side bridges extending between the ear portions at the level of the cup emission surface portion;

wire electro-discharge machining a electro-discharge machining slot into said cup structure to provide wire electro-discharge machining access to the interior of said cup structure; and wire electro-discharge machining a transverse coil chamber into said interior through said electro-discharge machining slot such that said transverse coil chamber is formed between said cup base portion and said cup emissions surface portion, and at least partially covered by said cup emissions surface portion.

12. The method of producing a cathode for use in an x-ray tube assembly as described in claim 11, further comprising machining a plurality of radiused entranced edges around said essentially contiguous emissions surface perimeter.

* * * * *